US009797095B2

(12) United States Patent
Klein et al.

(10) Patent No.: US 9,797,095 B2
(45) Date of Patent: Oct. 24, 2017

(54) AQUEOUS SIZING COMPOSITIONS FOR SHADING IN SIZE PRESS APPLICATIONS

(75) Inventors: Cedric Klein, Brumath (FR); Heidrun Grether-Schene, Efringen-Kirchen (DE)

(73) Assignee: ARCHOMA IP GMBH, Reinach (CH)

( * ) Notice: Subject to any disclaimer, the term of this patent is extended or adjusted under 35 U.S.C. 154(b) by 0 days.

(21) Appl. No.: 13/576,816

(22) PCT Filed: Feb. 5, 2011

(86) PCT No.: PCT/EP2011/000546

§ 371 (c)(1), (2), (4) Date: Aug. 2, 2012

(87) PCT Pub. No.: WO2011/098237

PCT Pub. Date: Aug. 18, 2011

(65) Prior Publication Data

US 2012/0311798 A1 Dec. 13, 2012

(30) Foreign Application Priority Data

Feb. 11, 2010 (EP) ..... 10001405

(51) Int. Cl.

| | |
|---|---|
| ***D21H 21/16*** | (2006.01) |
| ***D21H 21/18*** | (2006.01) |
| ***D21H 21/28*** | (2006.01) |
| ***D21H 21/30*** | (2006.01) |
| ***D21H 17/28*** | (2006.01) |
| ***D21H 17/36*** | (2006.01) |

(52) U.S. Cl.

CPC ..... *D21H 21/30* (2013.01); *D21H 17/28* (2013.01); *D21H 17/36* (2013.01); *D21H 21/16* (2013.01); *D21H 21/18* (2013.01); *D21H 21/28* (2013.01)

(58) Field of Classification Search

CPC ..... D21H 17/36; D21H 21/18; D21H 21/16; D21H 21/28; D21H 17/28; D21H 21/30

USPC ..... 8/648, 919; 252/8.81, 8.83, 8.86

See application file for complete search history.

(56) References Cited

U.S. PATENT DOCUMENTS

| | | | | |
|---|---|---|---|---|
| 2,153,697 | A * | 4/1939 | Porter | 8/495 |
| 4,200,489 | A | 4/1980 | Leifels et al. | |
| 4,210,488 | A | 7/1980 | Reuss et al. | |
| 4,374,643 | A | 2/1983 | Suzuki et al. | |
| 4,388,079 | A | 6/1983 | Suzuki et al. | |
| 6,030,443 | A | 2/2000 | Bock et al. | |
| 6,241,994 | B1 * | 6/2001 | Lee et al. | 424/408 |
| 6,723,846 | B1 * | 4/2004 | Metzger et al. | 544/193.2 |
| 7,258,815 | B2 | 8/2007 | Drenker et al. | |
| 2001/0031775 | A1 * | 10/2001 | King et al. | 514/367 |
| 2007/0245503 | A1 | 10/2007 | Jackson et al. | |
| 2007/0277950 | A1 | 12/2007 | Skaggs et al. | |
| 2010/0129553 | A1 * | 5/2010 | Jackson et al. | 427/288 |

FOREIGN PATENT DOCUMENTS

| | | | |
|---|---|---|---|
| CN | 1373758 | A | 10/2002 |
| CN | 101094842 | A | 12/2007 |
| EP | 0884312 | | 12/1998 |
| EP | 0899373 | | 3/1999 |
| EP | 1355004 | | 10/2003 |
| EP | 1612209 | * | 1/2006 |
| GB | 1293804 | | 10/1972 |
| GB | 2068428 | A | 8/1981 |
| JP | S-56-92964 | A | 7/1981 |
| JP | S-57-25364 | A | 2/1982 |
| JP | S-57-25365 | A | 2/1982 |
| JP | H-10503756 | A | 4/1998 |
| JP | 2000/160076 | A | 6/2000 |
| JP | 2012-520962 | A | 9/2012 |
| WO | 01/19804 | A1 | 3/2001 |
| WO | WO 02/18705 | | 3/2002 |
| WO | WO 02/055646 | | 7/2002 |
| WO | 2006/041954 | A | 4/2006 |
| WO | WO 2006/061399 | | 6/2006 |
| WO | WO 2007/017336 | | 2/2007 |
| WO | WO 2009/118247 | | 10/2009 |
| WO | 2009/150180 | A1 | 12/2009 |
| WO | 2011/009632 | A1 | 1/2011 |

OTHER PUBLICATIONS

International Search Report for PCT/EP2011/000546 mail dated Apr. 8, 2011.

International Preliminary Report on Patentability for PCT/EP2011/000546 mail dated Aug. 14, 2012.

G.A. Smook, Handbook for Pulp & Paper Technologies, 2nd Edition (1992), pp. 283-286.

G.A. Smook, Handbook for Pulp & Paper Technologies, 2nd Edition (1992), Chapter 13, pp. 194-208.

G.A. Smook, Handbook for Pulp & Paper Technologies, 2nd Edition (1992), Chapter 15, pp. 220-227.

* cited by examiner

*Primary Examiner* — Amina Khan

(74) *Attorney, Agent, or Firm* — McBee Moore Woodward & Vanik IP, LLC

(57) ABSTRACT

The instant invention relates to liquid sizing compositions comprising shading dyestfuffs, derivatives of diaminostilbene, binders, protective polymers, and optionally divalent metal salts which can be used for the optical brightening of substrates, including substrates suitable for high quality ink jet printing.

27 Claims, No Drawings

AQUEOUS SIZING COMPOSITIONS FOR SHADING IN SIZE PRESS APPLICATIONS

The instant invention relates to aqueous sizing compositions comprising derivatives of diaminostilbene optical brightener, shading dyes, binders and optionally divalent metal salts which can be used for the optical brightening of substrates, including substrates suitable for high quality ink jet printing.

BACKGROUND OF THE INVENTION

High levels of whiteness and brightness are important parameters for the end-user of paper products. The most important raw materials of the papermaking industry are cellulose, pulp and lignin which naturally absorb blue light and therefore are yellowish in color and impart a dull appearance to the paper.

The distinction between whiteness and brightness is well-known to those skilled in the art and is discussed, for example, in WO 0 218 705 A1.

Optical brighteners are used in the papermaking industry to compensate for the absorption of blue light by absorbing UV-light with a maximum wavelength of 350-360 nm and converting it into visible blue light with a maximum wavelength of 440 nm.

It is well established that, in addition to optical brighteners, certain shading dyes or pigments can be added to the paper in order to achieve a higher level of whiteness and to control the shade of the white paper.

WO 0 218 705 A1 however teaches that the use of shading dyes or pigments, while having a positive effect on whiteness, has a negative effect on brightness. The solution to this problem is to add additional optical brightener, the advantage claimed in WO 0 218 705 A1 being characterized by the use of a mixture comprising at least one direct dye (exemplified by CI Direct Violet 35) or pigment and at least one optical brightener.

Surprisingly, we have now discovered a sizing composition comprising an optical brightener and a shading dye which enables the papermaker to reach a high level of whiteness without significant loss in brightness.

Therefore, the goal of the present invention is to provide aqueous sizing compositions containing derivatives of diaminostilbene optical brightener, shading dyes, binders and optionally divalent metal salts affording enhanced high whiteness levels while avoiding the loss of brightness characterized by the use of shading dyes or pigments when applied to the paper at the size press.

The present invention further provides a process for optical brightening and tinting paper substrates characterized in that an aqueous sizing composition containing at least one optical brightener, at least one shading dye, at least one binder and optionally at least one divalent metal salt is used.

DESCRIPTION OF THE INVENTION

The present invention therefore provides aqueous sizing compositions for optical brightening of substrates, preferably paper, comprising (a) at least one optical brightener of formula (I)

(I)

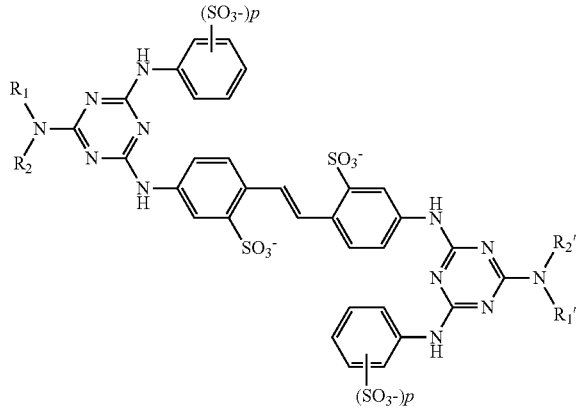

in which the anionic charge on the brightener is balanced by a cationic charge composed of one or more identical or different cations selected from the group consisting of hydrogen, an alkali metal cation, alkaline earth metal, ammonium, ammonium which is mono-, di-, tri- or tetrasubstituted by a $C_1$-$C_4$ linear or branched alkyl radical, ammonium which is mono-, di-, tri- or tetrasubstituted by a $C_1$-$C_4$ linear or branched hydroxyalkyl radical, or mixtures of said compounds, $R_1$ and $R_1'$ may be the same or different, and each is hydrogen, $C_1$-$C_4$ linear or branched alkyl, $C_2$-$C_4$ linear or branched hydroxyalkyl, $CH_2CO_2^-$, $CH_2CH_2CONH_2$ or $CH_2CH_2CN$, $R_2$ and $R_2'$ may be the same or different, and each is $C_1$-$C_4$ linear or branched alkyl, $C_2$-$C_4$ linear or branched hydroxyalkyl, $CH_2CO_2^-$, $CH(CO_2^-)CH_2CO_2^-$, $CH(CO_2^-)CH_2CH_2CO_2^-$, $CH_2CH_2SO_3^-$, $CH_2CH_2CO_2^-$, $CH_2CH(CH_3)CO_2^-$, benzyl, or $R_1$ and $R_2$ and/or $R_1'$ and $R_2'$, together with the neighboring nitrogen atom signify a morpholine ring and is 0, 1 or 2, (b) at least one dye of formula (II)

(II)

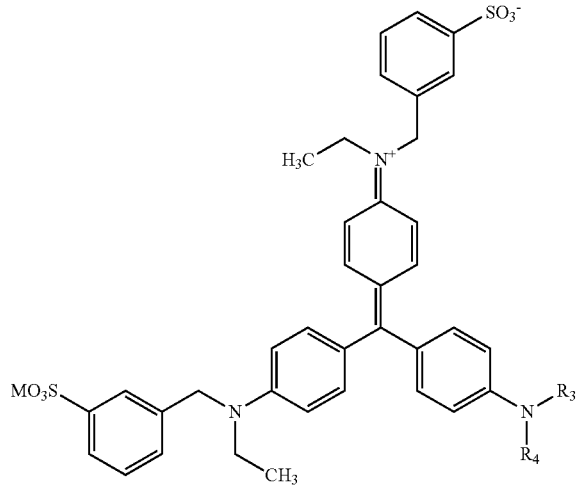

in which $R_3$ signifies H, methyl or ethyl, $R_4$ signifies paramethoxyphenyl, methyl or ethyl, M signifies a cation selected from the group consisting of hydrogen, an alkali metal cation, alkaline earth metal, ammonium, ammonium which is mono-, di-, tri- or tetrasubstituted by a $C_1$-$C_4$ linear or branched alkyl radical, ammonium which is mono-, di-, tri- or tetrasubstituted by a $C_1$-$C_4$ linear or branched hydroxyalkyl radical, or mixtures of said compounds, (c) at least one binder, (d) optionally one or more divalent metal salts and (e) water.

In compounds of formula (I) for which p is 1, the $SO_3^-$ group is preferably in the 4-position of the phenyl group.

In compounds of formula (I) for which p is 2, the $SO_3^-$ groups are preferably in the 2,5-positions of the phenyl group.

Preferred compounds of formula (I) are those in which the anionic charge on the brightener is balanced by a cationic charge composed of one or more identical or different cations selected from the group consisting of hydrogen, an alkali metal cation, alkaline earth metal, ammonium which is mono-, di-, tri- or tetrasubstituted by a $C_1$-$C_4$ linear or branched hydroxyalkyl radical, or mixtures of said compounds, $R_1$ and $R_1'$ may be the same or different, and each is hydrogen, $C_1$-$C_4$ linear or branched alkyl, $C_2$-$C_4$ linear or branched hydroxyalkyl, $CH_2CO_2^-$, $CH_2CH_2CONH_2$ or $CH_2CH_2CN$, $R_2$ and $R_2'$ may be the same or different, and each is $C_1$-$C_4$ linear or branched alkyl, $C_2$-$C_4$ linear or branched hydroxyalkyl, $CH_2CO_2^-$, $CH(CO_2^-)CH_2CO_2^-$ or $CH_2CH_2SO_3^-$ and p is 0, 1 or 2.

More preferred compounds of formula (I) are those in which the anionic charge on the brightener is balanced by a cationic charge composed of one or more identical or different cations selected from the group consisting of $Li^+$, $Na^+$, $K^+$, $Ca^{2+}$, $Mg^{2+}$, ammonium which is mono-, di-, tri- or tetrasubstituted by a $C_1$-$C_4$ linear or branched hydroxyalkyl radical, or mixtures of said compounds, $R_1$ and $R_1'$ may be the same or different, and each is hydrogen, methyl, ethyl, propyl, α-methylpropyl, β-methylpropyl, β-hydroxyethyl, β-hydroxypropyl, $CH_2CO_2^-$, $CH_2CH_2CONH_2$ or $CH_2CH_2CN$, $R_2$ and $R_2'$ may be the same or different, and each is methyl, ethyl, propyl, α-methylpropyl, β-methylpropyl, β-hydroxyethyl, β-hydroxypropyl, $CH_2CO_2^-$, $CH(CO_2^-)CH_2CO_2^-$ or $CH_2CH_2SO_3^-$ and p is 0, 1 or 2.

Especially preferred compounds of formula (I) are those in which the anionic charge on the brightener is balanced by a cationic charge composed of one or more identical or different cations selected from the group consisting of $Na^+$, $K^+$ and triethanolammonium or mixtures of said compounds, $R_1$ and $R_1'$ may be the same or different, and each is hydrogen, ethyl, propyl, β-hydroxyethyl, β-hydroxypropyl, $CH_2CO_2^-$, or $CH_2CH_2CN$, $R_2$ and $R_2'$ may be the same or different, and each is ethyl, propyl, β-hydroxyethyl, β-hydroxypropyl, $CH_2CO_2^-$, $CH(CO_2^-)CH_2CO_2^-$ or $CH_2CH_2SO_3^-$ and p is 1 or 2.

The concentration of compounds of formula (I) in the sizing composition may be between 0.2 and 30 g/l, preferably between 1 and 25 g/l, most preferably between 2 and 20 g/l.

Preferred compounds of formula (II) are those in which $R_3$ signifies H, methyl or ethyl, $R_4$ signifies paramethoxyphenyl, methyl or ethyl, M signifies a cation selected from the group consisting of hydrogen, an alkali metal cation, alkaline earth metal, ammonium which is mono-, di-, tri- or tetrasubstituted by a $C_1$-$C_4$ linear or branched hydroxyalkyl radical, or mixtures of said compounds.

More preferred compounds of formula (II) are those in which $R_3$ signifies methyl or ethyl, $R_4$ signifies methyl or ethyl, M signifies a cation selected from the group consisting of $Li^+$, $Na^+$, $K^+$, ½ $Ca^{2+}$, ½ $Mg^{2+}$, ammonium which is mono-, di-, tri- or tetrasubstituted by a $C_1$-$C_4$ linear or branched hydroxyalkyl radical, or mixtures of said compounds.

Especially preferred compounds of formula (II) are those in which $R_3$ signifies methyl, $R_4$ signifies methyl, M signifies a cation selected from the group consisting of $Na^+$, $K^+$ and triethanolammonium or mixtures of said compounds.

The concentration of compounds of formula (II) in the sizing composition may be between 0.01 and 20 mg/l, preferably between 0.05 and 10 mg/l, most preferably between 0.1 and 5 mg/l.

The binder is typically an enzymatically or chemically modified starch, e.g. oxidized starch, hydroxyethylated starch or acetylated starch. The starch may also be native starch, anionic starch, a cationic starch, or an amphoteric starch depending on the particular embodiment being practiced. While the starch source may be any, examples of starch sources include corn, wheat, potato, rice, tapioca, and sago. One or more secondary binders e.g. polyvinyl alcohol may also be used.

The concentration of binders in the sizing composition may be between 1 and 30% by weight, preferably between 2 and 20% by weight, most preferably between 5 and 15% by weight, % by weight based on the total weight of the sizing composition.

Preferred divalent metal salts are selected from the group consisting of calcium chloride, magnesium chloride, calcium bromide, magnesium bromide, calcium iodide, magnesium iodide, calcium nitrate, magnesium nitrate, calcium formate, magnesium formate, calcium acetate, magnesium acetate, calcium citrate, magnesium citrate, calcium gluconate, magnesium gluconate, calcium ascorbate, magnesium ascorbate, calcium sulphite, magnesium sulphite, calcium bisulphite, magnesium bisulphite, calcium dithionite, magnesium dithionite, calcium sulphate, magnesium sulphate, calcium thiosulphate, magnesium thiosulphate or mixtures of said compounds.

More preferred divalent metal salts are selected from the group consisting of calcium chloride, magnesium chloride, calcium bromide, magnesium bromide, calcium sulphate, magnesium sulphate, calcium thiosulphate or magnesium thiosulphate or mixtures of said compounds.

Especially preferred divalent metal salts are selected from the group consisting of calcium chloride, magnesium chloride, calcium sulphate or magnesium sulphate or mixtures of said compounds.

When the sizing composition contains divalent metal salts, the concentration of divalent metal salts in the sizing composition may be between 0.1 and 100 g/l, preferably between 0.5 and 75 g/l, most preferably between 1 and 50 WI.

When the divalent metal salt is a mixture of one or more calcium salts and one or more magnesium salts, the amount of calcium salts may be in the range of 0.1 to 99.9% by weight, % by weight based on the total weight of divalent metal salts.

The pH value of the sizing composition is typically in the range of from 5 to 13, preferably of from 6 to 11. Where it is necessary to adjust the pH of the sizing composition, acids or bases may be employed. Examples of acids which may be employed include but are not restricted to hydrochloric acid, sulphuric acid, formic acid and acetic acid. Examples of bases which may be employed include but are not restricted to alkali metal and alkaline earth metal hydroxide or carbonates.

In addition to one or more compounds of formula (I), one or more compounds of formula (II), one or more binders, optionally one or more divalent metal salts and water, the sizing composition may contain by-products formed during the preparation of compounds of formula (I) and compounds of formula (II) as well as other conventional paper additives. Examples of such additives are carriers, defoamers, wax emulsions, dyes, inorganic salts, solubilizing aids, preservatives, complexing agents, biocides, surface sizing agents, cross-linkers, pigments, special resins etc.

Optionally, the sizing composition can contain polyethyleneglycol. When the sizing composition contains polyethyleneglycol, the ratio in parts of polyethyleneglycol per part of compounds of formula (I) may be of from 0.05/1 to 2/1, preferably of from 0.1/1 and 1.5/1, more preferably of from 0.15/1 to 1/1 to function as a so-called carrier in order to boost the performances of compounds of formula (I) or compounds of formula (II). The polyethylene glycol which may be employed as carrier may have an average molecular weight in the range of 100 to 8000, preferably in the range of 200 to 6000, most preferably in the range of 300 to 4500.

Optionally, the sizing composition can contain polyvinyl alcohol. When the sizing composition contains polyvinyl alcohol, the ratio in parts of polyvinyl alcohol per part of compounds of formula (I) may be of from 0.005/1 to 1/1, preferably of from 0.025/1 to 0.5/1, more preferably of from 0.05/1 to 0.3/1 to function as a so-called carrier in order to boost the performances of compounds of formula (I) or compounds of formula (II). The polyvinyl alcohol which may be employed as carrier has a degree of hydrolysis greater than or equal to 60% and a Brookfield viscosity of between 1 and 60 mPa·s for a 4% aqueous solution at 20° C. Preferably the degree of hydrolysis is between 70% and 95%, and the Brookfield viscosity is between 1 and 50 mPa·s (4% aqueous solution at 20° C.). Most preferably, the degree of hydrolysis is between 70% and 90%, and the Brookfield viscosity is between 1 and 40 mPa·s (4% aqueous solution at 20° C.).

The sizing composition may be prepared by adding one or more compounds of formula (I), one or more compounds of formula (II), optionally one or more divalent metal salts and water to a preformed aqueous solution of the binder at a temperature between 20° C. and 90° C.

Compounds of formula (I), compounds of formula (II), and optionally the divalent metal salts can be added in any order, or at the same time to the preformed aqueous solution containing the binder at a temperature between 20° C. and 90° C.

Compounds of formula (I), compounds of formula (II), and optionally the divalent metal salts can be added as powders or as preformed aqueous solutions to the preformed aqueous solution containing the binder at a temperature between 20° C. and 90° C.

When used as a preformed aqueous solution, the concentration of compound of formula (I) in water is preferably of from 1 to 50% by weight, more preferably of from 2 to 40% by weight, even more preferably from 10 to 30% by weight, the % by weight being based on the total weight of the preformed aqueous solution containing the compound of formula (I).

When used as a preformed aqueous solution, the concentration of compound of formula (II) in water is preferably of from 0.1 to 25% by weight, more preferably of from 0.5 to 20% by weight, even more preferably from 1 to 10% by weight, the % by weight being based on the total weight of the preformed aqueous solution containing the compound of formula (II).

When used as a preformed aqueous solution, the concentration of divalent metal salt in water is preferably of from 1 to 80% by weight, more preferably of from 2 to 70% by weight, even more preferably from 3 to 60% by weight, the % by weight being based on the total weight of the preformed aqueous solution containing the divalent metal salt.

A further subject of the invention therefore is the use of the sizing compositions as defined above, also in all their preferred embodiments, preferably for optical brightening of cellulosic substrates, e.g. textiles, non-wovens or more preferably paper.

The sizing composition may be applied to the surface of a paper substrate by any surface treatment method known in the art. Examples of application methods include size-press applications, calendar size application, tub sizing, coating applications and spraying applications. (See, for example, pages 283-286 in Handbook for Pulp & Paper Technologists by G. A. Smook, 2$^{nd}$ Edition Angus Wilde Publications, 1992 and US 2007/0277950). The preferred method of application is at the size-press such as puddle size press. A preformed sheet of paper is passed through a two-roll nip which is flooded with the sizing composition. The paper absorbs some of the composition, the remainder being removed in the nip.

The paper substrate contains a web of cellulose fibres which may be sourced from any fibrous plant. Preferably the cellulose fibres are sourced from hardwood and/or softwood. The fibres may be either virgin fibres or recycled fibres, or any combination of virgin and recycled fibres.

The cellulose fibres contained in the paper substrate may be modified by physical and/or chemical methods as described, for example, in Chapters 13 and 15 respectively in Handbook for Pulp & Paper Technologists by G. A. Smook, Edition Angus Wilde Publications, 1992. One example of a chemical modification of the cellulose fibre is the addition of an optical brightener as described, for example, in EP 0 884 312, EP 0 899 373, WO 02/055646, WO 2006/061399 and WO 2007/017336.

The following examples shall demonstrate the instant invention in more details. In the present application, if not indicated otherwise, "parts" means "parts by weight" and "%" means "% by weight".

EXAMPLES

Preparative Example 1

An aqueous shading solution (S1) containing compound of formula (1) is prepared by slowly adding 40 parts of compound of formula (1) to 460 parts of water at room temperature with efficient stirring. The obtained solution is stirred for 1 hour and filtered to remove insoluble particles. The resulting shading solution (S1) has a pH in the range of from 6.0 to 7.0 and contains 8% by weight of compound of formula (1), the % by weight being based on the total weight of the final aqueous shading solution (S1).

(1)

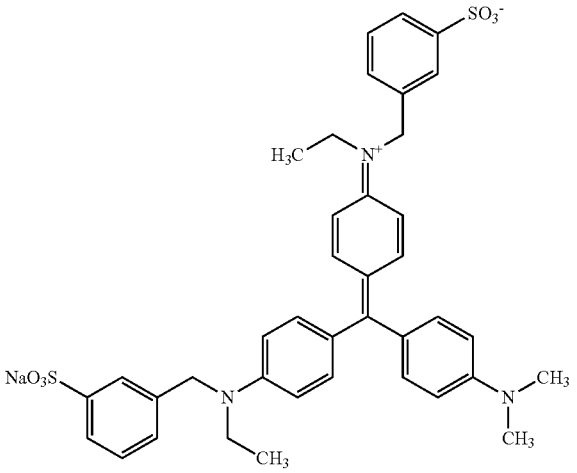

Application Example 1

Aqueous sizing compositions are prepared by adding aqueous shading solution (S1) containing compound of formula (1) prepared according to Preparative Example 1 at a range of concentrations of from 0 to 30 mg/l (from 0 to 2.4 mg/l of compound of formula (1) based on dry solid) to a stirred, aqueous solution containing calcium chloride (35 g/l), compound of formula (2) (7.5 g/l) and an anionic starch (50 g/l) (Penford Starch 260) at 60° C. The sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier. The dried paper is allowed to condition, and then measured for CIE whiteness and brightness on a calibrated Auto Elrepho spectrophotometer. The results are shown in Table 1 and Table 2 respectively and clearly show that the instant invention provides a high level of whiteness without significant loss of brightness.

(2)

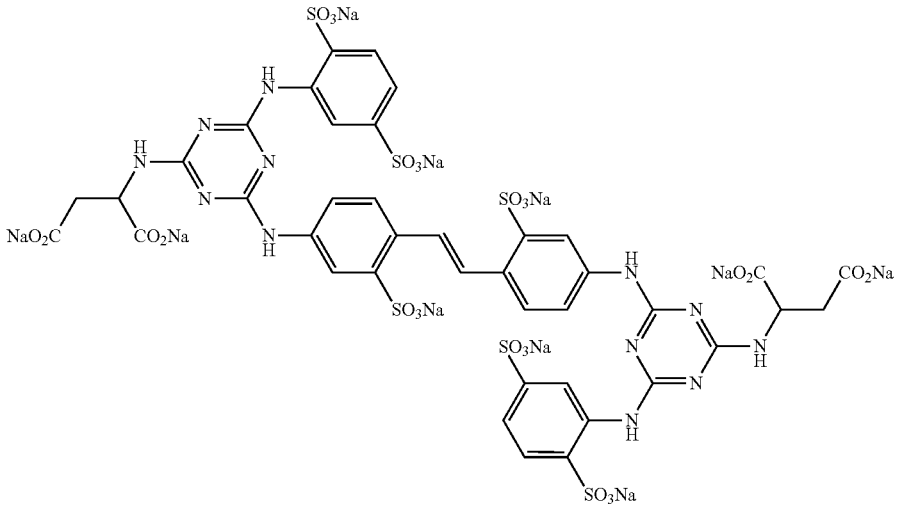

Comparative Application Example 1

Aqueous sizing compositions are prepared by adding aqueous solution of CI Direct Violet 35 (approx. 11% by weight of dry CI Direct Violet 35, the % by weight being based on the total weight of the CI Direct Violet 35 aqueous solution) at a range of concentrations of from 0 to 30 mg/l (from 0 to 3.3 mg/l based on dry CI Direct Violet 35 compound) to a stirred, aqueous solution containing calcium chloride (35 g/l), compound of formula (2) (7.5 g/l) and an anionic starch (50 g/l) (Penford Starch 260) at 60° C. The sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier.

The dried paper is allowed to condition, and then measured for CIE whiteness and brightness on a calibrated Auto Elrepho spectrophotometer. The results are shown in Table 1 and Table 2 respectively and clearly show that CI Direct Violet 35, a shading dye representative of the state-of-the-art, has a less positive effect on whiteness than the shading dye of the instant invention while having a very negative effect on brightness.

TABLE 1

| Added shading solution [mg/l] | CIE Whiteness Application Example 1 | CIE Whiteness Comparative Application Example 1 |
|---|---|---|
| 0 | 132.4 | 132.4 |
| 2.5 | 133.1 | 132.5 |
| 5 | 134.2 | 132.9 |
| 10 | 136.3 | 133.4 |
| 20 | 138.0 | 135.9 |
| 30 | 139.7 | 136.6 |

TABLE 2

| Added shading solution [mg/l] | Brightness Application Example 1 | Brightness Comparative Application Example 1 |
|---|---|---|
| 0 | 105.2 | 105.2 |
| 2.5 | 105.4 | 104.0 |
| 5 | 105.3 | 103.8 |
| 10 | 105.3 | 103.6 |
| 20 | 104.8 | 102.7 |
| 30 | 104.5 | 101.6 |

Application Example 2

Aqueous sizing compositions are prepared by adding preformed aqueous solution containing compound of formula (2) (18.2% by weight of compound of formula (2), the % by weight being based on the total weight of the aqueous solution containing compound of formula (2)) at a range of concentrations of from 0 to 60 WI (of from 0 to approx. 11 g/l based on dry compound of formula (2)) to a stirred, aqueous solution containing compound of formula (1) (4.0 mg/l) and an anionic potato starch (75 g/l) (Perfectamyl A4692 from AVEBE B.A.) at 60° C. The sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier.

The dried paper is allowed to condition, and then measured for CIE whiteness and brightness on a calibrated Auto Elrepho spectrophotometer. The results are shown in Table 3 and Table 4 respectively and clearly show that the instant invention provides excellent build-ups of both whiteness and brightness.

Comparative Application Example 2

Aqueous sizing compositions are prepared by adding preformed aqueous solution containing compound of formula (2) (18.2% by weight of compound of formula (2), the % by weight being based on the total weight of the aqueous solution containing compound of formula (2)) at a range of concentrations of from 0 to 60 g/l (of from 0 to approx. 11 g/l based on dry compound of formula (2)) to a stirred, aqueous solution containing an anionic potato starch (75 g/l) (Perfectamyl A4692 from AVEBE B.A.) at 60° C. The sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier.

The dried paper is allowed to condition, and then measured for CIE whiteness and brightness on a calibrated Auto Elrepho spectrophotometer. The results are shown in Table 3 and Table 4 respectively and clearly show that the absence of the shading dye has no effect on the brightness build-up, but has a negative effect on the whiteness build-up.

TABLE 3

| Added OBA solution [g/l] | CIE Whiteness Application Example 2 | CIE Whiteness Comparative Application Example 2 |
|---|---|---|
| 0 | 106.8 | 102.7 |
| 10 | 126.3 | 123.4 |
| 20 | 134.0 | 130.5 |
| 30 | 139.0 | 135.3 |
| 40 | 142.0 | 138.1 |
| 60 | 144.9 | 141.8 |

TABLE 4

| Added OBA solution [g/l] | Brightness Application Example 2 | Brightness Comparative Application Example 2 |
|---|---|---|
| 0 | 93.1 | 92.8 |
| 10 | 100.3 | 100.3 |
| 20 | 103.3 | 103.1 |
| 30 | 105.2 | 105.1 |
| 40 | 106.4 | 106.3 |
| 60 | 107.9 | 107.9 |

Application Example 3

Aqueous sizing compositions are prepared by adding preformed aqueous solution containing compound of formula (3) (14.7% by weight of compound of formula (3), the % by weight being based on the total weight of the aqueous solution containing compound of formula (3)) at a range of concentrations of from 0 to 60 g/l (of from 0 to approx. 9 g/l based on dry compound of formula (3)) to a stirred, aqueous solution containing compound of formula (1) (4.0 mg/l) and an anionic potato starch (75 g/l) (Perfectamyl A4692 from AVEBE B.A.) at 60° C. The sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier.

The dried paper is allowed to condition, and then measured for CIE whiteness and brightness on a calibrated Auto Elrepho spectrophotometer. The results are shown in Table 5 and Table 6 respectively and clearly show that the instant invention provides excellent build-ups of both whiteness and brightness.

(3)

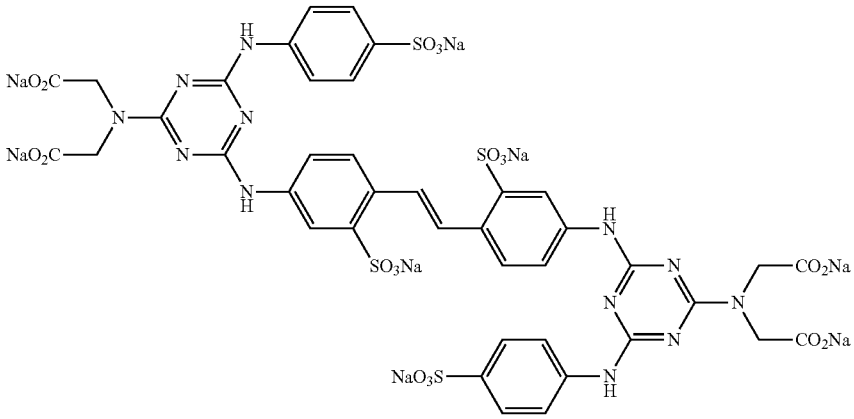

Comparative Application Example 3

Aqueous sizing compositions are prepared by adding preformed aqueous solution containing compound of formula (3) (14.7% by weight of compound of formula (3), the % by weight being based on the total weight of the aqueous solution containing compound of formula (3)) at a range of concentrations of from 0 to 60 g/l (of from 0 to approx. 9 g/l based on dry compound of formula (3)) to a stirred, aqueous solution containing an anionic potato starch (75 g/l) (Perfectamyl A4692 from AVEBE B.A.) at 60° C. The sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier.

The dried paper is allowed to condition, and then measured for CIE whiteness and brightness on a calibrated Auto Elrepho spectrophotometer. The results are shown in table 5 and table 6 respectively and clearly show that the absence of the shading dye has no effect on the brightness build-up, but has a negative effect on the whiteness build-up.

TABLE 5

| Added OBA solution [g/l] | CIE Whiteness | |
|---|---|---|
| | Application Example 3 | Comparative Application Example 3 |
| 0 | 106.8 | 102.7 |
| 10 | 125.8 | 122.7 |
| 20 | 132.9 | 129.5 |
| 30 | 136.8 | 133.5 |
| 40 | 138.8 | 136.4 |
| 60 | 141.4 | 139.0 |

TABLE 6

| Added OBA solution [g/l] | Brightness | |
|---|---|---|
| | Application Example 3 | Comparative Application Example 3 |
| 0 | 93.1 | 92.8 |
| 10 | 100.0 | 100.3 |
| 20 | 102.9 | 103.1 |
| 30 | 104.7 | 104.7 |

TABLE 6-continued

| Added OBA solution [g/l] | Brightness | |
|---|---|---|
| | Application Example 3 | Comparative Application Example 3 |
| 40 | 105.5 | 106.0 |
| 60 | 107.0 | 107.4 |

The invention claimed is:

1. An aqueous sizing composition for optical brightening of substrates, including paper, comprising a) at least one optical brightener of formula (I)

(I)

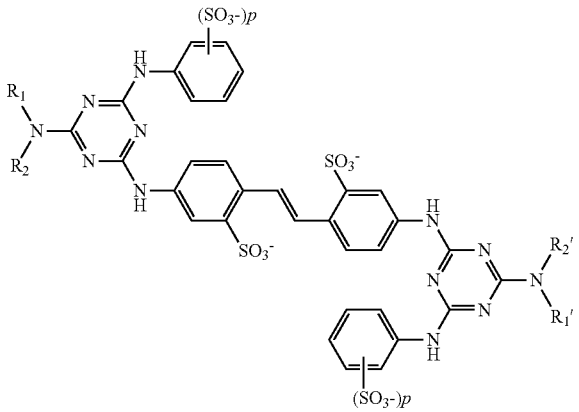

wherein the anionic charge on the brightener is balanced by a cationic charge including one or more identical or different cations selected from the group consisting of hydrogen, an alkali metal cation, alkaline earth metal, ammonium, ammonium which is mono-, di-, tri- or tetrasubstituted by a $C_1$-$C_4$ linear or branched alkyl radical, ammonium which is mono-, di-, tri- or tetrasubstituted by a $C_1$-$C_4$ linear or branched hydroxyalkyl radical, and mixtures thereof, $R_1$ and $R_1'$ are the same or different, and each is hydrogen, $C_1$-$C_4$ linear or branched alkyl, $C_2$-$C_4$ linear or branched hydroxyalkyl, $CH_2CO_2^-$, $CH_2CH_2CONH_2$ or $CH_2CH_2CN$, $R_2$ and $R_2'$ are the same or different, and each is $C_1$-$C_4$ linear or branched alkyl, $C_1$-$C_4$ linear or branched hydroxyalkyl, $CH_2CO_2^-$, $CH(CO_2^-)CH_2CO_2^-$, $CH(CO_2^-)CH_2CH_2CO_2^-$, $CH_2CH_2SO_3^-$, $CH_2CH_2CO_2^-$, $CH_2CH(CH_3)CO_2^-$, benzyl, or $R_1$ and $R_2$ and/or $R_1'$, and $R_2'$, together with the neighboring nitrogen atom signify a morpholine ring and p is 0, 1 or 2, b) at least one dye of formula (II)

(II)

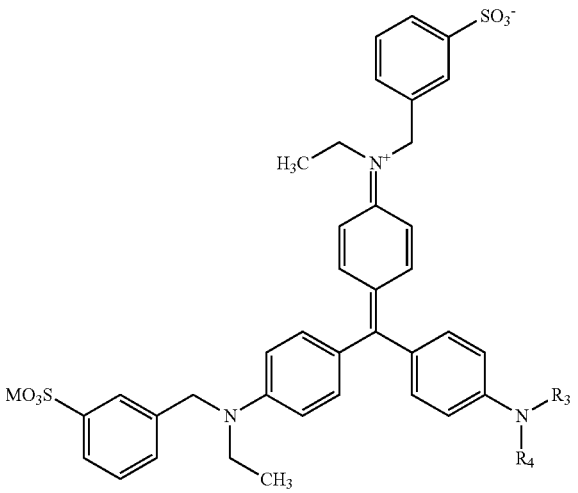

wherein $R_3$ is methyl or ethyl, $R_4$ is methyl or ethyl,

M is a cation selected from the group consisting of hydrogen, an alkali metal cation, alkaline earth metal, ammonium, ammonium which is mono-, di-, tri- or tetrasubstituted by a $C_1$-$C_4$ linear or branched alkyl radical, ammonium which is mono-, di-, tri- or tetrasubstituted by a $C_1$-$C_4$ linear or branched hydroxyalkyl radical, or mixtures thereof, (c) at least one binder comprising enzymatically or chemically modified starch, oxidized starch, hydroxyethylated starch, acetylated starch, native starch, anionic starch, cationic starch, or amphoteric starch, (d) optionally one or more divalent metal salts and (e) water, wherein the concentration of compounds of formula (I) in the sizing composition is between 0.2 and 60 g/l and wherein the concentration of compounds of formula (II) in the sizing composition is between 0.01 and 30 mg/l.

2. The sizing composition according to claim 1, wherein in formula (I) the anionic charge on the brightener is balanced by a cationic charge composed of one or more identical or different cations selected from the group consisting of hydrogen, an alkali metal cation, alkaline earth metal, ammonium which is mono-, di-, tri- or tetrasubstituted by a $C_1$-$C_4$ linear or branched hydroxyalkyl radical, and mixtures thereof, $R_1$ and $R_1'$ are the same or different, and each is hydrogen, $C_1$-$C_4$ linear or branched alkyl, $C_2$-$C_4$ linear or branched hydroxyalkyl, $CH_2CO_2^-$, $CH_2CH_2CONH_2$ or $CH_2CH_2CN$, $R_2$ and $R_2'$ are the same or different, and each is $C_1$-$C_4$ linear or branched alkyl, $C_2$-$C_4$ linear or branched hydroxyalkyl, $CH_2CO_2^-$, $CH(CO_2^-)CH2CO_2^-$ or $CH_2CH_2SO_3^-$ and p is 0, 1 or 2.

3. The sizing composition according to claim 1, wherein in formula (I) the anionic charge on the brightener is balanced by a cationic charge including one or more identical or different cations selected from the group consisting of $Li^+$, $Na^{+1}$ $K^+$, $Ca^{2+}$, $Mg^{2+}$, ammonium which is mono-, di-, tri- or tetrasubstituted by a $C_1$-$C_4$ linear or branched hydroxyalkyl radical, and mixtures thereof, $R_1$ and $R_1'$ are the same or different, and each is hydrogen, methyl, ethyl, propyl, α-methylpropyl, β-methylpropyl, β -hydroxyethyl, β-hydroxypropyl, $CH_2CO_2^-$, $CH_2CH_2CONH_2$ or $CH_2CH_2CN$, $R_2$ and $R_2'$ are the same or different, and each is methyl, ethyl, propyl, α-methylpropyl, β-methylpropyl, β-hydroxyethyl, β-hydroxypropyl, $CH_2CO_2^-$,$CH(CO_2^-)CH_2CO_2^-$ or $CH_2CH_2SO_3^{31}$ and p is 0, 1 or 2.

4. The sizing composition according to claim 1, wherein in formula (I) the anionic charge on the brightener is balanced by a cationic charge including one or more identical or different cations selected from the group consisting of $Na^+$, $K^+$ and triethanolammonium and mixtures thereof, $R_1$ and $R_1'$ are the same or different, and each is hydrogen, ethyl, propyl, β-hydroxyethyl, β-hydroxypropyl, $CH_2CO_2^-$, or $CH_2CH_2CN$, $R_2$ and $R_2'$ may be are the same or different, and each is ethyl, propyl, β-hydroxyethyl, β-hydroxypropyl, $CH_2CO_2^-$, $CH(CO_2^-)CH2CO_2^-$or $CH_2CH_2SO_3^-$ and p is 1 or 2.

5. The sizing composition according to claim 1, wherein the concentration of compounds of formula (I) in the sizing composition is between 0.2 and 30 g/l.

6. The sizing composition according to claim 1, wherein in formula (II)

$R_3$ is methyl or ethyl, $R_4$ is methyl or ethyl,

M is a cation selected from the group consisting of hydrogen, an alkali metal cation, alkaline earth metal, ammonium which is mono-, di-, tri- or tetrasubstituted by a $C_1$-$C_4$ linear or branched hydroxyalkyl radical, and mixtures thereof.

7. The sizing composition according to claim 1, wherein

R3 is methyl or ethyl,

R4 is methyl or ethyl,

M is a cation selected from the group consisting of $Li^+$, $Na^+$, $K^+$, $½Ca^{2+}½Mg^{2+}$, ammonium which is mono-, di-, tri- or tetrasubstituted by a $C_1$-$C_4$ linear or branched hydroxyalkyl radical, and mixtures thereof.

8. The sizing composition according to claim 1, wherein $R_3$ is methyl, $R_4$ is methyl, M is a cation selected from the group consisting of $Na^+$, $K^+$and triethanolammonium and mixtures thereof.

9. The sizing composition according to claim 1, wherein the concentration of compounds of formula (II) in the sizing composition is between 0.01 and 20 mg/l.

10. The sizing composition according to claim 1, wherein the binder is an enzymatically or chemically modified starch, hydroxyethylated starch or acetylated starch.

11. The sizing composition according to claim 1, wherein the concentration of binders in the sizing composition is between 1 and 30% by weight based on the total weight of the sizing composition.

12. The sizing composition according to claim 1, wherein the divalent metal salts are present and are selected from the group consisting of calcium chloride, magnesium chloride, calcium bromide, magnesium bromide, calcium iodide, magnesium iodide, calcium nitrate, magnesium nitrate, calcium formate, magnesium formate, calcium acetate, magnesium acetate, calcium citrate, magnesium citrate, calcium gluconate, magnesium gluconate, calcium ascorbate, magnesium ascorbate, calcium sulphite, magnesium sulphite, calcium bisulphite, magnesium bisulphite, calcium dithionite, magnesium dithionite, calcium sulphate, magnesium sulphate, calcium thiosulphate, magnesium thiosulphate and mixtures thereof.

13. The sizing composition according to claim 1, wherein the divalent metal salts are present and are selected from the group consisting of calcium chloride, magnesium chloride, calcium sulphate, magnesium sulphate or mixtures thereof.

14. The sizing composition according to claim 1, wherein the concentration of divalent metal salts in the sizing composition is between 0.1 and 100 g/l.

15. The sizing composition according to claim 1, wherein the pH value of the sizing composition is in the range of from 5 to 13.

16. The sizing composition according to claim 1, wherein the sizing composition comprises additional additives, selected from the group consisting of one or more of carriers, defoamers, wax emulsions, dyes, inorganic salts, solubilizing aids, preservatives, complexing agents, biocides, surface sizing agents, cross-linkers, pigments and special resins.

17. The sizing composition according to claim 1, wherein the sizing composition further comprises polyethylene glycol or polyvinylalcohol.

18. The sizing composition according to claim 1, wherein the concentration of compounds of formula (I) in the sizing composition is between 1 and 25 g/l.

19. The sizing composition according to claim 1, wherein the concentration of compounds of formula (I) in the sizing composition is between 2 and 20 g/l.

20. The sizing composition according to claim 1, wherein the concentration of compounds of formula (II) in the sizing composition is between 0.05 and 10 mg/l.

21. The sizing composition according to claim 1, wherein the concentration of compounds of formula (II) in the sizing composition is between 0.1 and 5 mg/l.

22. The sizing composition according to claim 1, wherein the concentration of divalent metal salts in the sizing composition is between 0.5 and 75 g/l.

23. The sizing composition according to claim 1, wherein the concentration of divalent metal salts in the sizing composition is between 1 and 50 g/l.

24. The sizing composition according to claim 1, wherein the pH value of the sizing composition is in the range of from 6 to 11.

25. The sizing composition according to claim 1, wherein $R_1$ and $R_1'$ are the same, and each is hydrogen, ethyl, $C_2$-$C_3$ linear or branched hydroxyalkyl, $CH_2CH_2CN$, or $CH_2CO_2^-$;

$R_2$ and $R_2'$ are the same, and each is $C_2$-$C_4$ linear or branched alkyl, $C_2$-$C_3$ linear or branched hydroxyalkyl, $CH(CO_2^-)CH_2CO_2^{3I}$, or $CH_2CO_2^-$; and is 1 or 2.

26. A cellulosic substrate treated with a sizing composition according to claim 1.

27. The cellulosic substrate according to claim 26, wherein the cellulosic substrate comprises paper, and wherein the sizing composition has a positive effect on whiteness of said paper and no effect or a positive effect on brightness of said paper.

* * * * *